US007568851B2

(12) United States Patent
Yamamoto et al.

(10) Patent No.: US 7,568,851 B2
(45) Date of Patent: Aug. 4, 2009

(54) SHEET PACKAGE WITH IDENTIFICATION MARK AND PRINTER USING THE SAME

(75) Inventors: Minoru Yamamoto, Nagoya (JP); Keiji Seo, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 48 days.

(21) Appl. No.: 11/896,053

(22) Filed: Aug. 29, 2007

(65) Prior Publication Data

US 2008/0008515 A1 Jan. 10, 2008

Related U.S. Application Data

(62) Division of application No. 10/509,245, filed as application No. PCT/JP03/03204 on Mar. 17, 2003, now Pat. No. 7,281,873.

(30) Foreign Application Priority Data

Mar. 28, 2002 (JP) ..... 2002-092880

(51) Int. Cl.
*B41J 11/58* (2006.01)

(52) U.S. Cl. ..... 400/624; 271/145; 271/152; 206/214; 206/449; 206/459.1

(58) Field of Classification Search ..... 271/145, 271/152, 3.13; 206/214, 449, 459.1, 576; 400/624

See application file for complete search history.

(56) References Cited

U.S. PATENT DOCUMENTS

| | | | | |
|---|---|---|---|---|
| 4,122,457 | A | 10/1978 | Erikson et al. | |
| 5,053,814 | A | 10/1991 | Takano et al. | |
| 5,273,271 | A | 12/1993 | Intemann | |
| 5,717,976 | A * | 2/1998 | Chowdry et al. | 399/45 |
| 6,217,019 | B1 | 4/2001 | Ishiduka et al. | |
| 6,227,732 | B1 | 5/2001 | Higuchi et al. | |
| 6,246,466 | B1 | 6/2001 | Hirano et al. | |
| 6,431,358 | B1 | 8/2002 | Sasaki et al. | |
| 6,546,210 | B1 | 4/2003 | Nakamura | |

FOREIGN PATENT DOCUMENTS

| | | |
|---|---|---|
| EP | 1 099 639 A1 | 5/2001 |
| JP | A 62-153226 | 7/1987 |
| JP | A 2-243424 | 9/1990 |
| JP | A 3-25436 | 2/1991 |
| JP | A 4-317929 | 11/1992 |
| JP | 11091958 A * | 4/1999 |
| JP | A 11-240628 | 9/1999 |
| JP | A 11-240629 | 9/1999 |

(Continued)

*Primary Examiner*—Judy Nguyen
*Assistant Examiner*—Matthew G Marini
(74) *Attorney, Agent, or Firm*—Oliff & Berridge PLC

(57) ABSTRACT

Print sheets 7 stacked up are inserted into a package member 8 so that the sheets 7 in this state can be set in a printer together with the package member 8. The package member 8 is provided with an identification mark 31 while the printer is equipped with a reflective sensor so that the identification mark 31 will be placed in a reading area of the reflective sensor only when the sheet package 9 is loaded in the printer in a correct direction.

4 Claims, 8 Drawing Sheets

FOREIGN PATENT DOCUMENTS

| | | |
|---|---|---|
| JP | A 11-322125 | 11/1999 |
| JP | A 2000-168966 | 6/2000 |
| JP | A 2000-203725 | 7/2000 |
| JP | A 2001-139164 | 5/2001 |
| WO | WO 99/02348 A1 | 1/1999 |

* cited by examiner

SHEET PACKAGE WITH IDENTIFICATION MARK AND PRINTER USING THE SAME

This is a Division of application Ser. No. 10/509,245 filed Jun. 8, 2005, which is a National Phase of Application No. PCT/JP03/03204 filed Mar. 17, 2003. The entire disclosures of the prior applications are hereby incorporated by reference in their entirety.

TECHNICAL FIELD

The present invention relates to a configuration of a sheet package which stores a stack of sheets for a printer, and a configuration of a printer using such a sheet package.

BACKGROUND OF THE INVENTION

Direct thermal printers equipped with a line thermal head have been well known. Into such a direct thermal printer, heat-sensitive sheets in the form of cut sheets are stacked up and loaded. Some of such printers are configured to accommodate a sheet package in which numbers of heat-sensitive sheets are stacked up and wrapped by a package member.

In the printer, the sheets are fed into the thermal head one by one and each line orthogonal to the sheet feed direction is heated by the thermal head, by which arbitrary letters, images, etc. are printed on the sheets. As the heat-sensitive sheets, various types of sheets such as heat-coloring sheets and heat-perforated sheets can be used.

The heat-coloring sheet includes a base layer such as paper, a heat-sensitive record layer formed by applying a heat-coloring material on the base layer, and an overcoat layer formed by applying ultraviolet-curing resin, etc. on the heat-sensitive record layer and irradiating the resin with ultraviolet rays. When such a heat-coloring sheet is heated by the thermal head from the side of the overcoat layer (print surface), the heat-sensitive record layer in the heated part changes color. As a type of heat-coloring sheet, there exists a multicolor heat-sensitive sheet having a plurality of coloring layers. When the thermal head heats such a multicolor heat-sensitive sheet from the side of the coloring layers (print surface) while adjusting the amount of thermal energy, the heat-sensitive record layer in the heated part changes color accordingly.

The heat-perforated sheet includes a thermoplastic film, a porous base, and an adhesive layer for bonding them together. When such a heat-perforated sheet is heated by the thermal head of the printer from the side of the thermoplastic film (print surface), the thermoplastic film is perforated to change color of the sheet in a desired pattern (character string, etc.).

DISCLOSURE OF THE INVENTION

In either type of existing heat-sensitive sheet explained above, the printing is impossible when the heat-sensitive sheet is heated by the thermal head from a side opposite to the print surface. However, users sometimes set sheets in a printer in a wrong direction, and erroneously setting the sheets upside down results in failure of printing.

As another type of sheet for printing, there exists a duplicate sheet designed to allow simultaneous printing on two sheets. The duplicate sheet is formed by stacking up two sheets and bonding them together along one side. The duplicate sheet has to be set with the bonded part placed at the front end in the sheet feed direction, and loading the sheet back to front causes a paper jam in the printer.

Therefore, in a possible distribution pattern, the process for making the sheet package by inserting the sheets into the package member may be carried out by the manufacture, and each user may purchase the sheets in the form of the sheet package and use the sheets by setting the sheet package in the printer. In this case, the insertion of the sheets into the package member is done by the manufacturer and thus setting the sheets in a wrong direction is almost impossible in this process.

However, even in this case, the process of setting the sheet package in the printer is done by the user and there is a possibility that the user sets the sheet package in a wrong direction, resulting in printer trouble.

It is therefore the primary object of the present invention to provide a sheet package and a printer using the sheet package, capable of letting the user set the sheet package in the printer in the correct direction and thereby preventing failure and trouble in printing.

In accordance with an aspect of the present invention, there is provided a sheet package comprising sheets as print mediums for a printer and a package member surrounding the sheets which have been stacked up, which is configured so that the sheets can be set in the printer together with the package member exposing part of the sheets. In the sheet package, the package member is provided with an identification mark so that the identification mark will be placed in a reading area of a sensor provided in the printer only when the sheet package is set in the printer in a correct direction.

By the above configuration of the sheet package, when the sheet package is set in the printer in a wrong direction, the erroneous setting can be detected by the printer. Therefore, print failure/trouble can be prevented by letting the user set the sheet package in the correct direction.

Preferably, the sheet package is configured so that the identification mark will be placed in the reading area of the sensor provided in the printer only when the sheet package is set in the printer in the correct direction and the sheets are partially exposed from the package member.

With this configuration, setting the sheet package in the printer before opening the package can also be detected, by which print failure/trouble can be prevented more securely.

The package member may be integrally provided with a flap part so that the flap part can be set in a closed state in which the sheets are totally covered by the package member and in an opened state in which the sheets are partially exposed. In this case, the flap part may be provided with the identification mark so that the identification mark will be placed in the reading area of the sensor provided in the printer when the flap part has been set in the opened state.

An error mark for letting the sensor detect an error may be formed at a position on the package member that corresponds to a position where the identification mark exists when the flap part is in the opened state. The error mark is placed in the reading area of the sensor of the printer when the sheet package is set in the printer with the flap part closed.

The identification mark may indicate information on the sheets. By such configuration, the identification mark can also be used for automatic judgment on the type, thickness, etc. of the sheets stored in the sheet package.

The identification mark may be formed by a plurality of indicator bits. By such configuration, a plurality of sheet types can be indicated by various combination patterns of the indicator bits, enabling automatic judgment by the sensor of the printer. Due to the simple bit indication, the structure of the sensor for reading the information can be simplified and thereby the cost of the printer can be reduced.

An error mark for letting the sensor detect an error may be formed at every part of the sheet package or the sheets that can be placed in the reading area of the sensor when the sheet package is set in the printer in an incorrect direction.

With this configuration, the error mark is necessarily placed at the position of the sensor when the sheet package is set in the printer in an incorrect direction, by which the setting error can be detected without fail.

The error mark may be formed by a plurality of indicator bits indicating the same information, by which the error mark can be configured by simple composition.

An error mark for letting the sensor detect an error may be formed at a part of the sheet package or the sheets that can be placed in the reading area of the sensor when the sheet package is set in the printer back to front.

An error mark for letting the sensor detect an error may be formed at a part of the sheet package or the sheets that can be placed in the reading area of the sensor when the sheet package is set in the printer upside down.

In accordance with another aspect of the present invention, there is provided a system comprising: a sheet package including sheets as print mediums and a package member surrounding the sheets stacked up; and a printer using the sheet package. In the system, the printer includes a sensor. The sheet package is configured so that the sheets can be set in the printer together with the package member exposing part of the sheets. The package member is provided with an identification mark so that the identification mark will be placed in a reading area of the sensor of the printer only when the sheet package is set in the printer in a correct direction. The printer operates depending on whether the identification mark can be read by the sensor or not.

The printer may be configured to inform a user of an error when the identification mark can not be read by the sensor.

With this configuration, the user setting the sheet package in an incorrect direction is informed of the error and can quickly cope with the situation by resetting the sheet package in the correct direction.

The printer may also be configured to regulate its sheet feed operation when the identification mark can not be read by the sensor.

The identification mark may indicate information on the sheets, and the printer may recognize the type of the sheets by letting the sensor read the information on the sheets indicated by the identification mark.

With this configuration, the printer reading the identification mark can automatically judge the type of the sheets stored in the sheet package along with detecting that the direction of the sheets is correct. Printer control (control of sheet feed speed, the printing head, etc.) becomes possible based on the information.

The identification mark may be formed by a plurality of indicator bits, and the printer may include a plurality of sensors corresponding to the indicator bits forming the identification mark.

With this configuration, the printer can recognize the direction of the sheet package and the type of the sheets stored in the sheet package by letting the sensors read the combination of corresponding indicator bits.

An error mark for letting the sensor detect an error may be formed at every part of the sheet package or the sheets that can be placed in the reading area of the sensor when the sheet package is set in the printer in an incorrect direction. The error mark is formed by a plurality of indicator bits indicating the same information. The printer is configured to inform the user of an error and regulate its sheet feed operation when all the sensors read the same value.

With this configuration, in the case where the same value is read by all the sensors, the printer judges that one of the error marks has been read by the sensors due to incorrect setting of the sheet package, by which sheet feed operation with the incorrect sheet setting can be avoided and thereby the print failure/trouble can be prevented from occurring.

The sensor may be implemented by a reflective sensor, by which the recognition and reading of the identification mark can be attained by a sensor of simple composition.

BEST MODE FOR CARRYING OUT THE INVENTION

Figure 1:
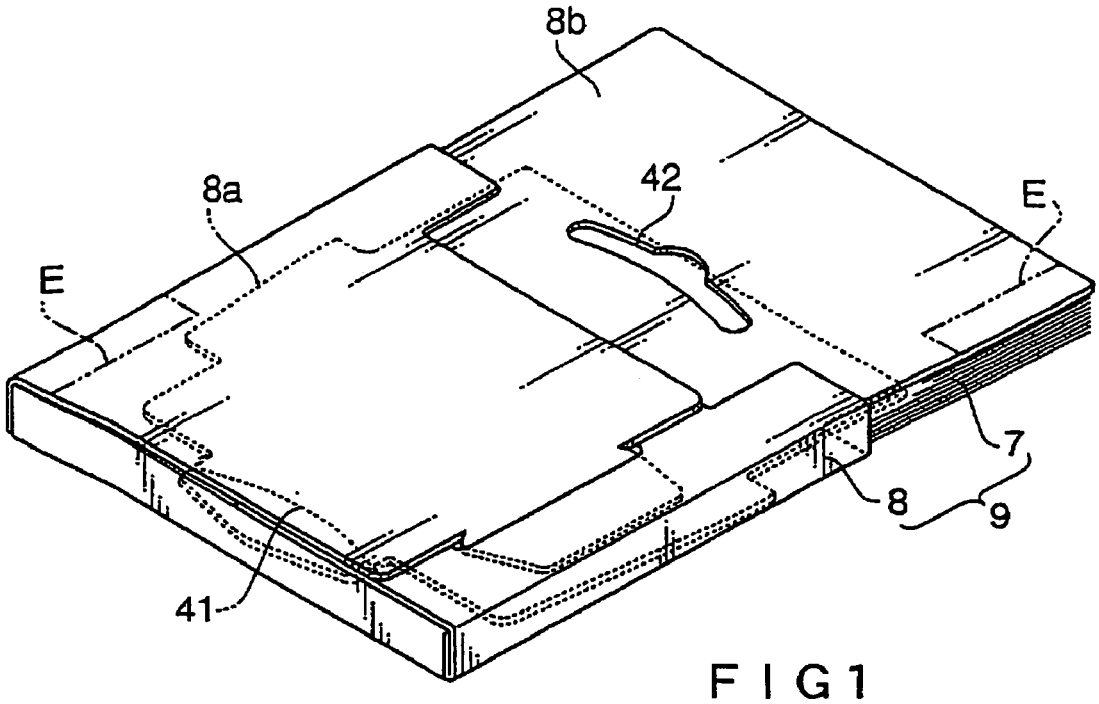
FIG. 1 is a perspective view of a sheet package before being loaded in a printer seeing the sheet package from above.

Referring now to the drawings, a description will be given in detail of preferred embodiments in accordance with the present invention.

First, a sheet package 9 will be explained below referring to FIGS. 1 through 5.

Figure 2:
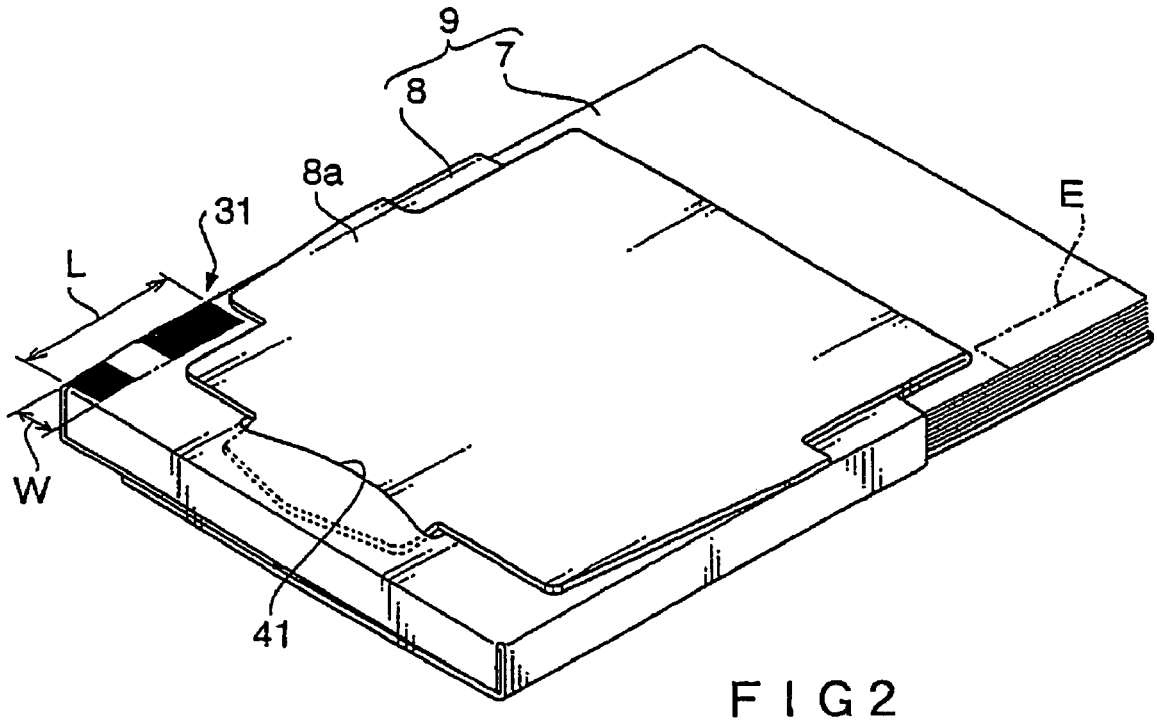
FIG. 2 is a perspective view of the sheet package before being loaded in the printer seeing the sheet package from below.
Figure 3:
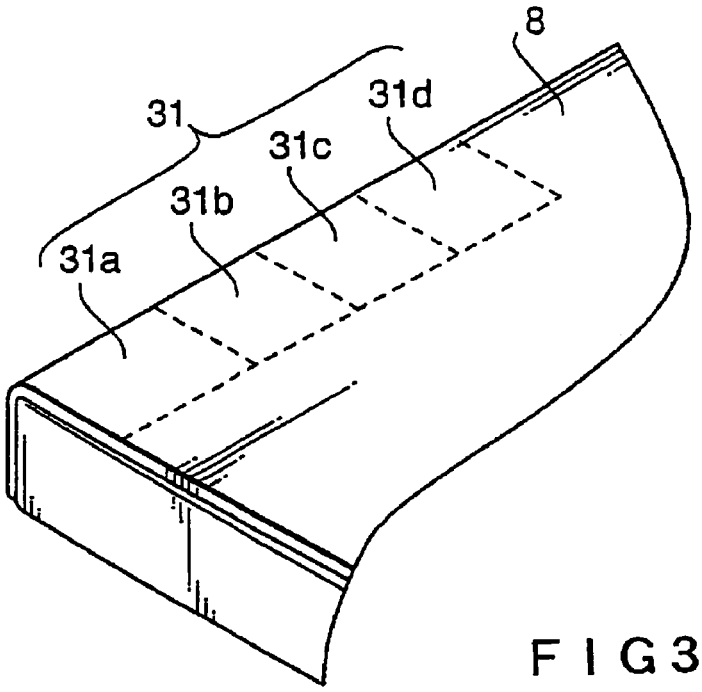
FIG. 3 is an enlarged view showing a part of the sheet package on which an identification mark is formed.
Figure 4:
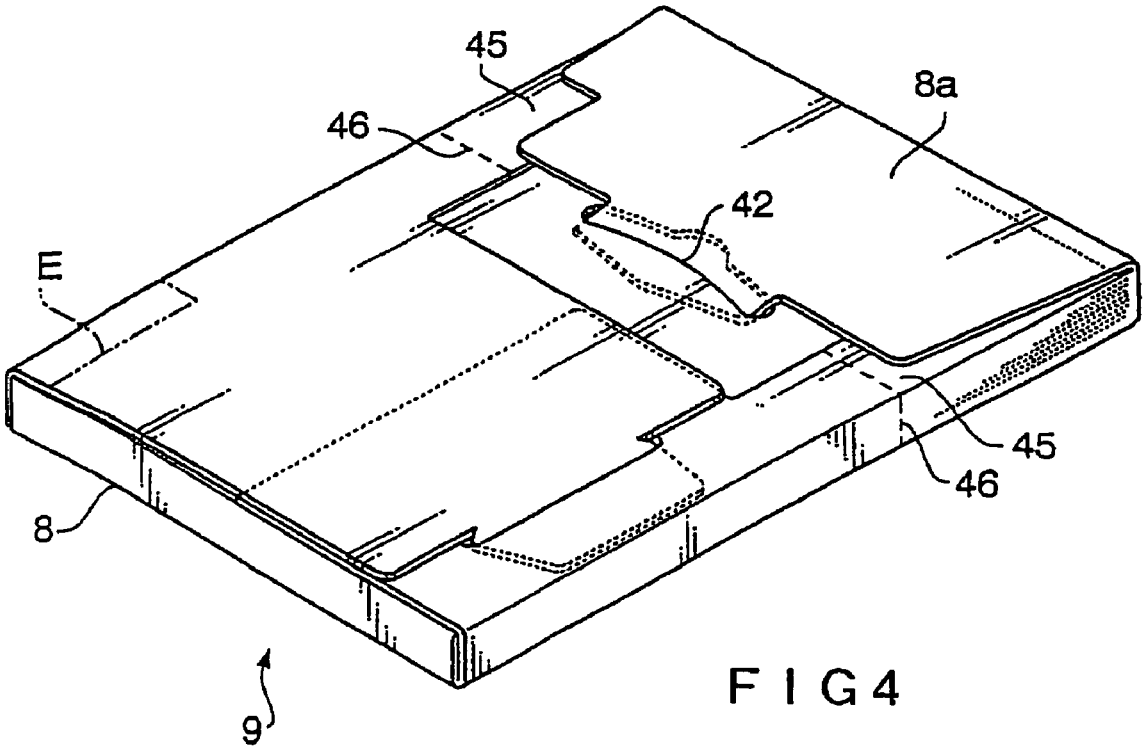
FIG. 4 is a perspective view showing the sheet package with its flap part closed.

FIG. 1 is a perspective view of the sheet package before being loaded in a printer, seeing the sheet package from above. FIG. 2 is a perspective view of the sheet package seeing it from below. FIG. 3 is an enlarged view showing a part of the sheet package on which an identification mark is formed.

As shown in FIG. 1, the sheet package 9 includes heat-sensitive paper 7 in the form of small-sized cut sheets of approximately A6-A7 size for example (print medium, hereinafter referred to as "sheets 7") and a package member 8 surrounding the sheets 7 which are stacked up.

The sheet package 9 is a package formed by storing a stack of the sheets 7 described above in the package member 8, as shown in FIG. 4. A user purchases the sheet package 9 in the state shown in FIG. 4, partially exposes the sheets 7 from the package member 8 as shown in FIG. 1 by a prescribed procedure, and sets the sheet package 9 in a printer 1. Incidentally, when a flap part 8*a* is opened, a tear-off part 45 is cut off along perforations 46.

Figure 5:
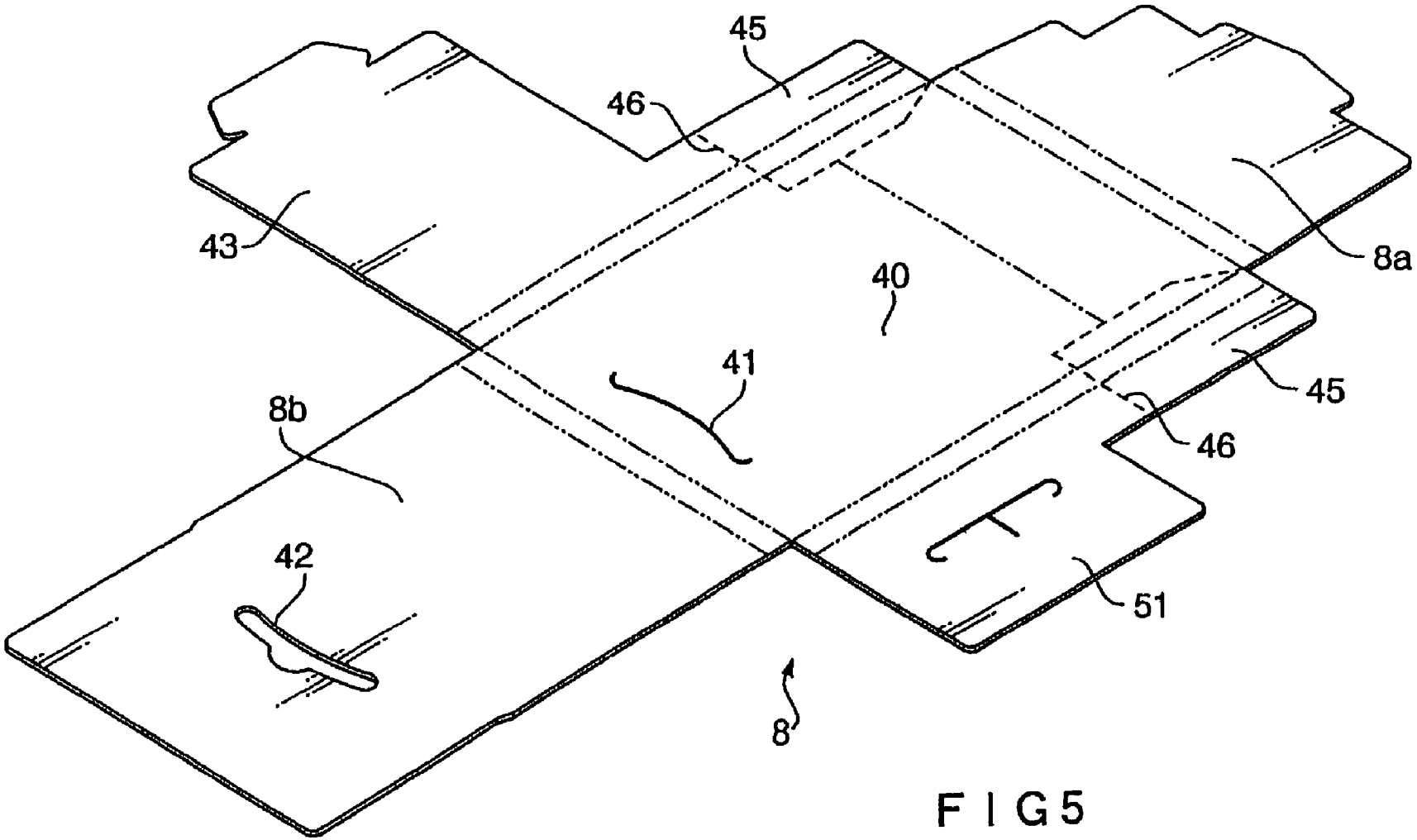
FIG. 5 is a developed view of the sheet package.

The package member 8 is formed by folding a plane cardboard material into a box shape. The cardboard material before being folded is shown in FIG. 5. The cardboard material includes a first wrapping part 51, a second wrapping part 43, a tongue part 8*b* and the flap part 8*a* which are integrally formed around a base 40 which is in almost the same (rectangular) shape as the sheet 7. Incidentally, thin chain lines in FIG. 5 indicate creased parts, which facilitates the folding of the cardboard material and the assembly of the package member 8.

As shown in FIG. 1, the foldable flap part 8*a* is formed integrally with the package member 8. FIG. 1 shows a state in which the foldable flap part 8*a* is folded down to the base 40 and fixed. In this state, a part of the stacked sheets 7 at an end in the lengthwise direction (sheet feed direction) exposes its lower surface as shown in FIG. 1. The sheet package 9 in the state of FIG. 1 is loaded in the printer 1 which will be explained later.

In order to fix the flap part 8*a* in the state of FIG. 1, a first cut 41 is made into the lower surface of the package member 8 so that the tip of the flap part 8*a* can be inserted therein.

Meanwhile, a second cut 42 is made into the upper surface of the package member 8 (the tongue part 8*b* which will be described later). The flap part 8*a* (originally in the state of FIG. 1) can also be folded oppositely toward the upper surface of the package member 8 and its tip can be inserted into the second cut 42, by which the flap part 8*a* can also be fixed in a state covering the sheets 7.

When the sheet package 9 is set in the printer, the tongue part 8*b* on the top of the sheets 7 is situated between a pressure board 18 (explained later) and the sheets 7. In the sheet feed operation of the printer, the sheets 7 are separated one by one and conveyed smoothly by causing proper friction between the tongue part 8*b* and the sheets 7.

FIG. 2 views the sheet package 9 from below. As shown in FIG. 2, a corner of the lower surface of the package member 8 (opposite to the side exposing the sheets 7) is provided with a rectangular identification mark 31. When the sheet package 9 is set in the printer 1 in the correct direction, the identification mark 31 is placed in a reading area of a reflective sensor 32 (see FIG. 8) of the printer 1 as will be described later. The identification mark 31 has a width W and a length L in the width direction and the lengthwise direction of the sheets 7.

The identification mark 31 is composed of four rectangular indicator bits 31*a*-31*d* as shown in FIG. 3. Among the four bits, 0-3 bits are colored black and remaining one bit is not colored (remains in the color (white) of the foundation of the package member 8). In the example of FIG. 2, the indicator bits 31*a*, 31*c* and 31*d* are colored black, while the remaining bit 31*b* is left white. The identification mark 31 can be formed by known methods such as printing.

The black/white pattern has been preset depending on the type of sheet (heat-sensitive paper of a normal type, heat-sensitive paper capable of gaining two colors, label paper, duplicate paper allowing simultaneous printing on two sheets, etc.) stored in the package member 8. The printer 1 recognizes the sheet type automatically by reading the pattern by the reflective sensor 32 (described later).

On the lower surface of the sheet package 9 shown in FIG. 2, at the opposite corner at the end of a diagonal line drawn from the identification mark 31, the sheets 7 are exposed from the package member 8 at least by the size W (width)×L (length) of the identification mark 31. The part forms an error mark E as explained below.

In this embodiment, the reflective sensor 32 regards an all-white mark as an error mark (explained later in detail). Therefore, the exposed part of the sheets (W (width)×L (length)) functions as an error mark.

It is unnecessary to form a particular error mark in cases where the package member 8 is white or the sheets stored in the package member 8 are white, that is, no problem occurs if the part that can face the reflective sensor 32 when the sheet package 9 is set in a wrong direction is white. In cases where the sheets 7 or the package member 8 is nonwhite, a particular error mark is formed by coloring the W×L part white by means of printing, etc.

Such error marks E are formed also on the upper surface of the sheet package 9 as shown in FIG. 1. The package member 8 exposes its corners (that come to the same positions as the aforementioned identification mark 31 and error mark E when the sheet package 9 is set upside down) at least by the size W (width)×L (length) of the identification mark 31, which serves as the error marks E.

In the following, the overall configuration of the printer 1 will be described referring to FIGS. 6 through 10.

Figure 6:
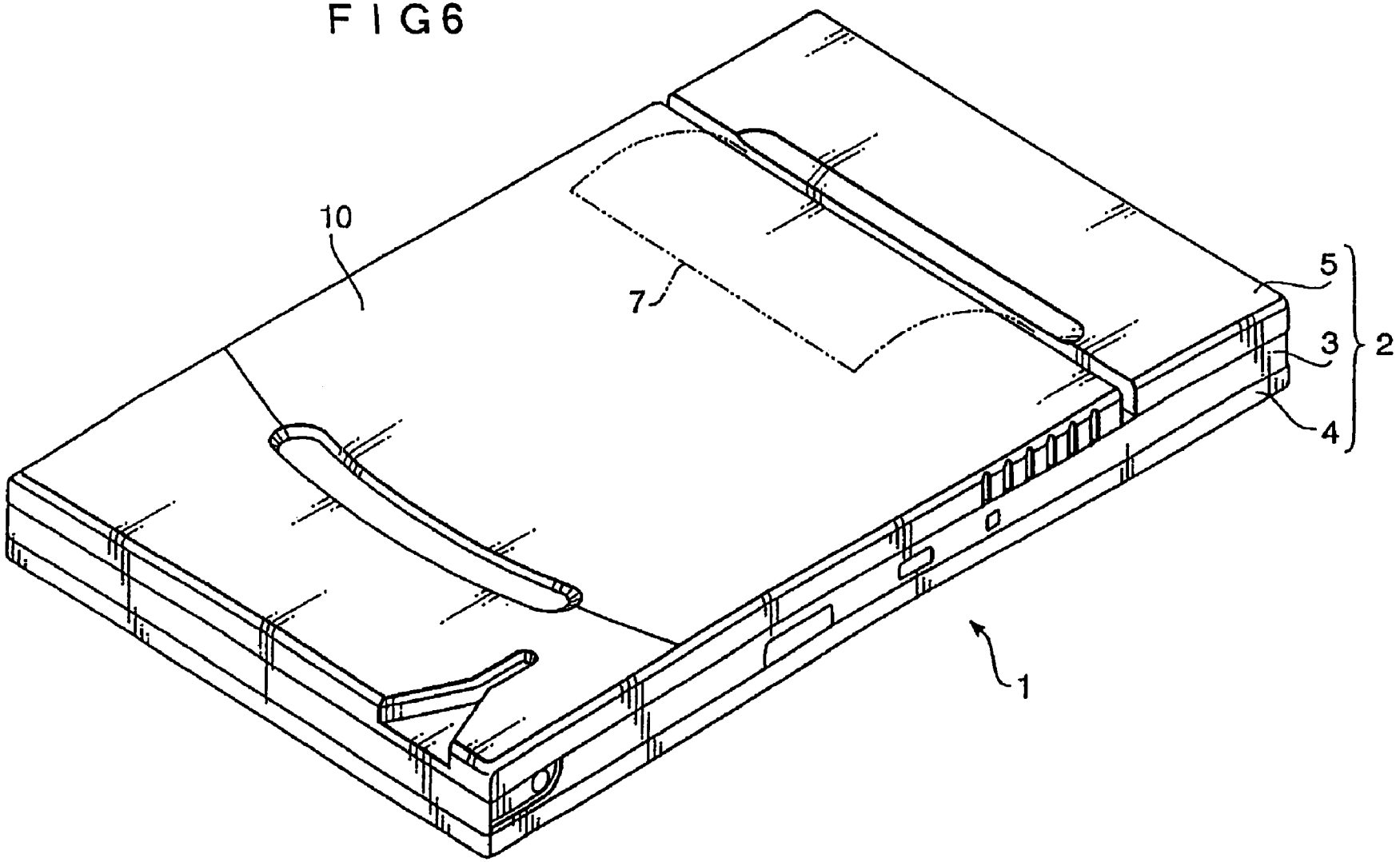
FIG. 6 is a perspective view of the printer.
Figure 7:
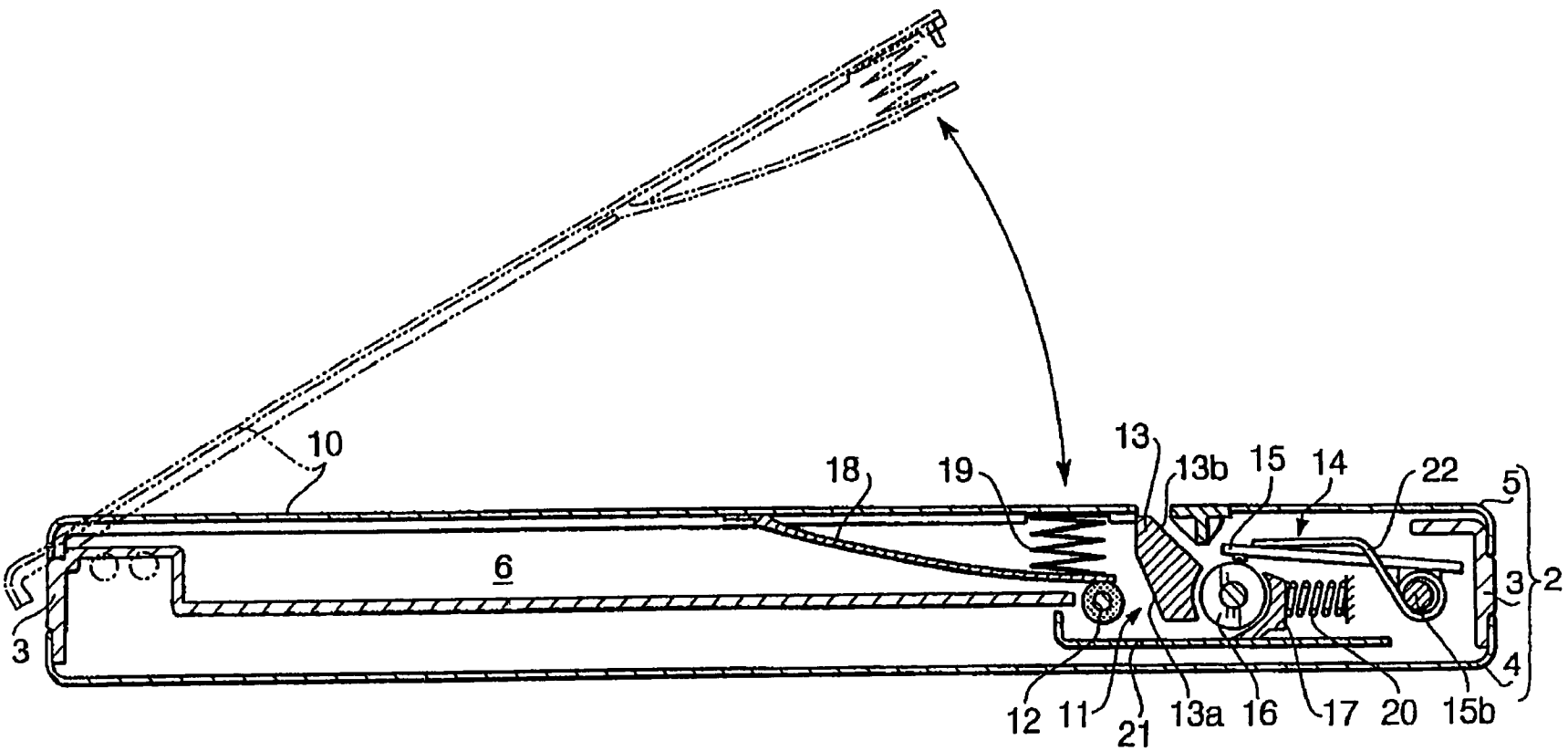
FIG. 7 is a sectional side view of the printer.
Figure 8:
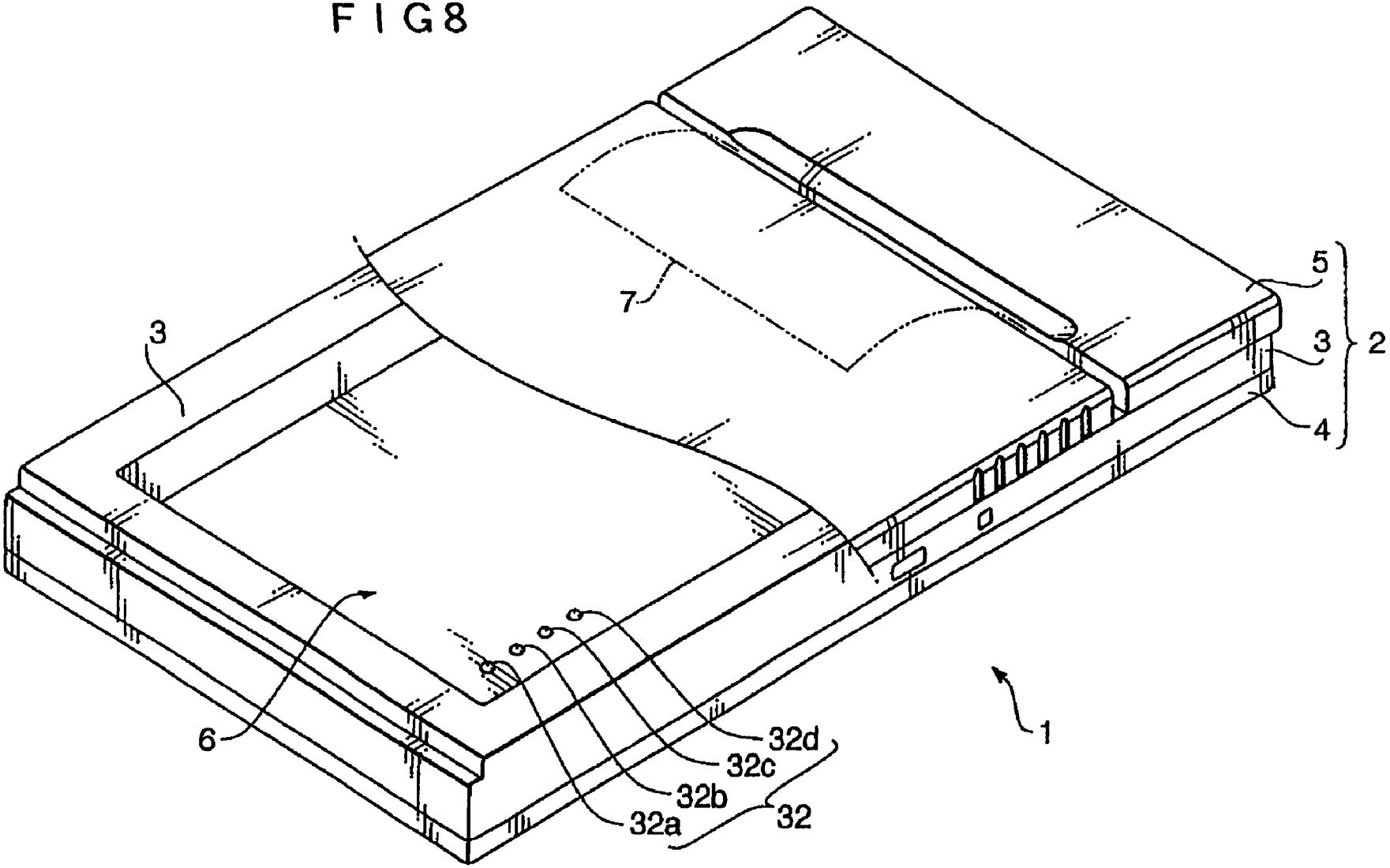
FIG. 8 is a perspective view showing a sheet storage unit of the printer.
Figure 9:
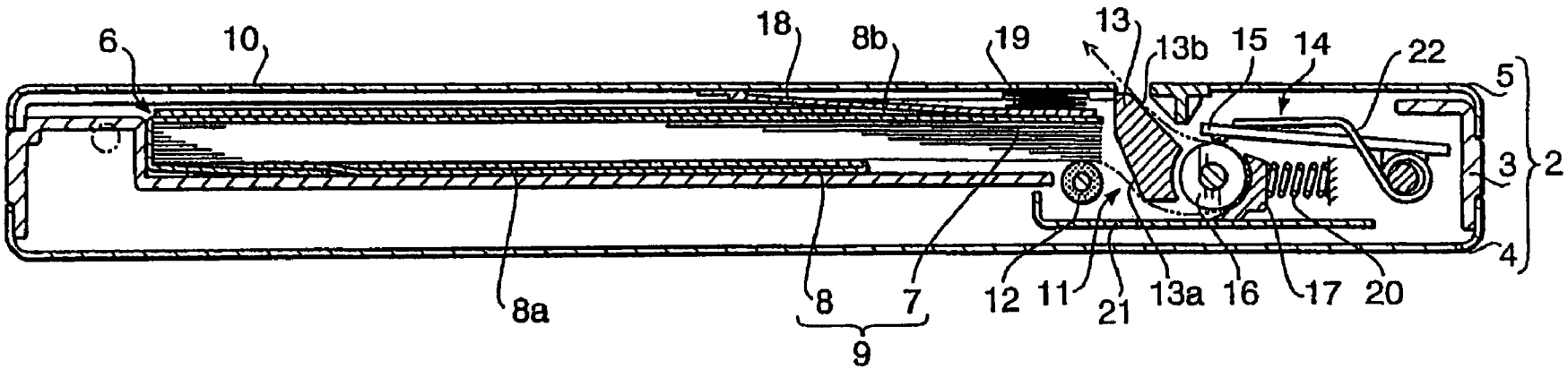
FIG. 9 is a sectional side view showing a state in which the sheets are set in the sheet storage unit.
Figure 10:
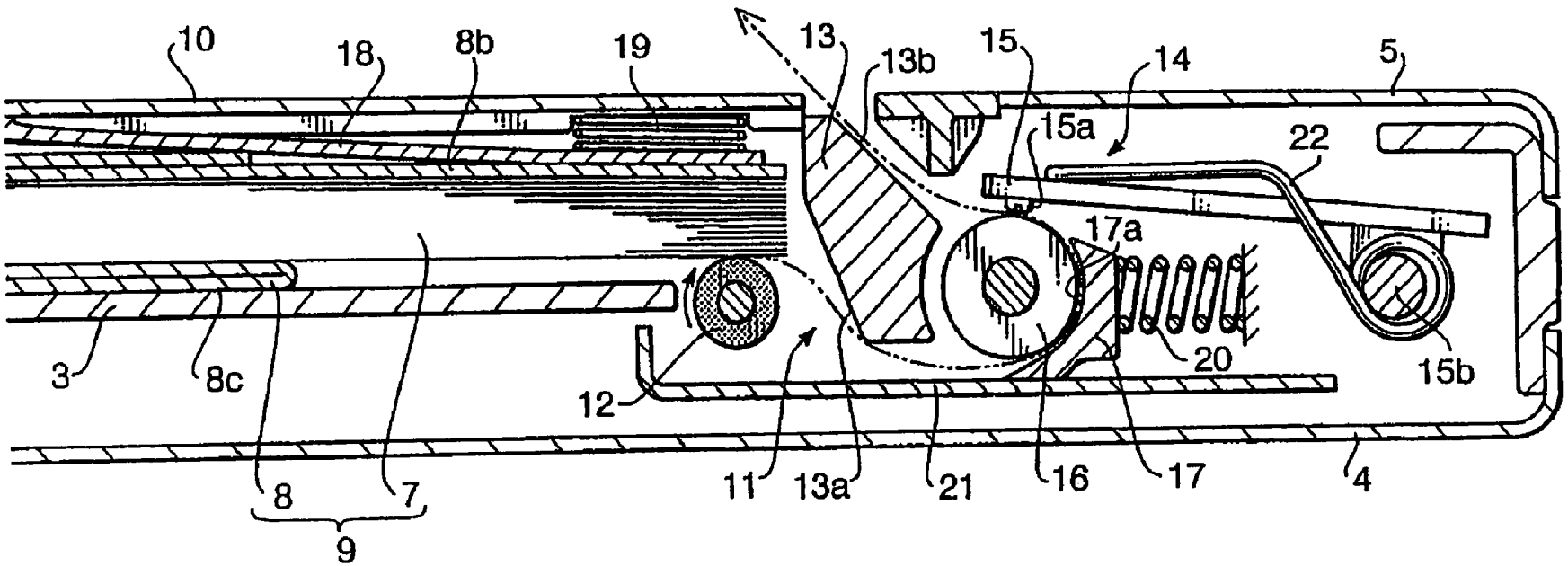
FIG. 10 is an enlarged sectional view showing the details of a sheet separation unit and a print mechanism unit.

FIG. 6 is a perspective view of the printer. FIG. 7 is a sectional side view of the printer. FIG. 8 is a perspective view showing a sheet storage unit of the printer. FIG. 9 is a sectional side view showing a state in which the sheets are set in the sheet storage unit. FIG. 10 is an enlarged sectional view showing the details of a sheet separation unit and a print mechanism unit.

As shown in FIG. 6, the printer 1 is formed compact in size, with a rectangular shape of approximately A6 size or A7 size in a plan view and a thickness of approximately 2 cm or less.

The printer 1 has a body case 2. The body case 2 includes a frame 3, a lower cover 4 covering the bottom of the frame 3, and an upper cover 5 covering part of the top of the frame 3.

In a part of the upper part of the frame 3 that is not covered with the upper cover 5, a sheet storage unit (sheet supply unit) 6 is formed as shown in FIG. 3. In the sheet storage unit 6, the sheet package 9 is inserted and set.

The top of the sheet storage unit 6 is covered with a lid 10, which is rotatable with respect to the body case 2 as shown in FIG. 7. The body case 2 is provided with an unshown lock mechanism, by which the lid 10 can be locked at a closed position as shown in FIG. 9 with the sheet package 9 loaded in the sheet storage unit 6 as described above.

At one end of the sheet storage unit 6, a sheet separation unit 11 including a pickup roller 12, a separation block 13, etc. is placed. Beneath the upper cover 5, a print mechanism unit 14 (described in detail later) including a thermal head 15, a platen roller 16 and a paper guide 17 is placed.

At the other end of the sheet storage unit 6, the reflective sensor 32 is provided to a corner on the bottom of the sheet storage unit 6 as shown in FIG. 8. The reflective sensor 32 includes four sensors 32*a*-32*d* arranged in a line corresponding to the aforementioned indicator bits 31*a*-31*d*. Each sensor 32*a*-32*d* emits light and measures reflected light, by which the state (black or white) of each corresponding indicator bit 31*a*-31*d* of the identification mark 31 is detected.

The sheet separation unit 11 will be explained below.

As shown in FIG. 10, to one end of the sheet storage unit 6 in the vicinity of the print mechanism unit 14 (right-hand side in FIG. 10), the pickup roller 12 and the separation block 13 are provided. On the inner surface of the lid 10 facing the sheet storage unit 6, a pressure plate 18 is supported rotatably. A coil spring 19 is placed between the pressure plate 18 and the lid 10 so as to constantly exert pressure on the pressure plate 18 to rotate it downward.

The aforementioned sheet package 9 is set in the sheet storage unit 6, with the lower surface of the lowermost one of the stacked sheets 7 (stacked up and stored in the package member 8 with their print surfaces facing downward) being exposed partially from the package member 8 as shown in FIG. 9. When the lid 10 is closed and locked, the pressure plate 18 (pressed downward by the aforementioned spring 19) presses the exposed part of the sheet 7 against the pickup roller 12 via the tongue part 8*b* of the package member 8, letting the lower surface of the sheet 7 contact the pickup roller 12.

The separation block 13, provided in the vicinity of the pickup roller 12, has a separation guide surface 13*a* being tilted with respect to the sheet feed direction of the pickup roller 12.

In this configuration the pickup roller 12 which is driven and rotated exerts feeding force on the lowermost sheet 7 contacting the pickup roller 12. As a principle, the lowermost sheet 7 is conveyed by the feeding force of the pickup roller 12 (caused by the spring 19) exceeding braking force from the separation guide surface 13*a* and negative frictional force from a (second) sheet on the conveyed sheet. The second lowermost sheet on the conveyed sheet receives positive frictional force from the lowermost sheet, negative frictional force from a third lowermost sheet and braking force from the separation guide surface 13*a* and thereby stays at its position with the force balance, by which multi feeding is avoided. With the separating function of the separation guide surface 13*a* of the separation block 13, only one sheet 7 at the bottom of the stacked sheets is separated and conveyed out of the sheet package 9.

The print mechanism unit 14 will be explained below.

The platen roller 16 is rotatably provided next to the separation block 13 (on the right-hand side of the separation block 13 in FIG. 10), and the paper guide 17 is placed close to the exterior surface of the platen roller 16. As shown in an enlarged view of FIG. 10, the paper guide 17 has a sliding surface 17*a* which is formed to have a concave sectional form like a tilted letter "U" along the exterior surface of the platen roller 16. Between the paper guide 17 and the body case 2, a pressure coil spring 20 is placed so as to press the sliding surface 17*a* against the exterior surface of the platen roller 16.

In this configuration, the sheet 7 separated by the aforementioned sheet separation unit 11 is conveyed by the pickup roller 12 and thereby passes through a gap between the bottom of the separation block 13 and a guide plate 21 for guiding the sheet 7 toward the platen roller 16.

The sheet 7 is guided by the guide plate 21 and fed beneath the platen roller 16 to a gap between the platen roller 16 and the paper guide 17. The sheet 7, held between the exterior surface of the platen roller 16 and the sliding surface 17*a* of the paper guide 17, is conveyed by the revolving platen roller 16 upward being turned over in the tilted U shape and reaches the top of the platen roller 16 with its print surface facing upward.

The thermal head 15, placed nearby the top of the platen roller 16, has a heating element unit 15*a* as a printing unit. The thermal head 15 is provided to be rotatable around a rotation axis 15*b*, by which the heating element unit 15*a* can contact and separate from the top of the platen roller 16.

Incidentally, the thermal head 15 is designed to be rotatable as above so that the thermal head 15 will not disturb a "jammed paper clearance operation" when the sheet 7 has got jammed between the platen roller 16 and the paper guide 17.

To the thermal head 15, an end of a spring 22 of a twisting coil spring type is attached, by which force for pressing the heating element unit 15*a* against the top of the platen roller 16 is applied to the thermal head 15 constantly.

In this configuration, the heating element unit 15*a* of the thermal head 15 makes contact with the upper surface of the sheet (conveyed by the platen roller 16 with its print surface facing upward as above) and the printing on the sheet 7 is carried out at the contacting part.

The thermal head 15, formed as a line head, is capable of printing arbitrary letters, images, etc. on the conveyed heat-sensitive sheet 7, by executing printing on each line orthogonal to the sheet feed direction. The print width on each line is set to a width which is approximately the same as the width of the sheet 7 as the target of printing.

Such a thermal head 15 is employed as the printing head for the following reasons. By use of the heat-sensitive sheets as the record mediums, consumable items like ink, ink ribbons, etc. become unnecessary and mechanisms such as an ink supply mechanism can be left out, by which the printer 1 can be designed compact in size.

On the aforementioned separation block 13, a sheet ejection guide surface 13*b*, being tilted relative to the sheet feed direction of the platen roller 16, is formed.

The sheet 7 after being printed by the heating element unit 15*a* of the thermal head 15 is guided by the sheet ejection guide surface 13*b* and thereby ejected to the upper side of the lid 10 through a gap between the lid 10 and the upper cover 5 of the body case 2, as shown in FIG. 6.

As explained above, in the printer 1 of this embodiment, each sheet 7 is conveyed so that the lower surface of the sheet 7 set in the sheet storage unit 6 will face the thermal head 15 for printing. Therefore, the sheets have to be set in the sheet storage unit 6 correctly (so as not to be upside down) with their print surfaces (heat-sensitive surfaces) facing downward.

To meet the requirement; in this embodiment, the sheets 7 are stored in the package member 8 in the correct direction by the manufacturer. The user purchases the sheet package 9 and sets it in the printer 1 avoiding the upside-down setting, by which each sheet 7 can be fed to the print mechanism unit 14 in the correct direction.

However, if the user sets the sheet package 9 upside down, a sheet feed error occurs. In this embodiment, the upside-down setting causes direct contact of the tongue part 8*b* with the pickup roller 12. In this case, in addition to the sheet feed error, strong friction developing between the pickup roller 12 and the tongue part 8*b* might overload a motor which drives the pickup roller 12.

Further, since the package member 8 of the sheet package 9 is opened at one end in its lengthwise direction and closed at the other end as shown in FIG. 1, the sheet package 9 has to be set correctly (avoiding back-to-front setting) so that the opened end will face toward the print mechanism unit 14. The back-to-front setting of the sheet package 9 makes the sheet feed operation totally impossible.

To eliminate such trouble, the sheet package 9 of this embodiment is provided with the identification mark 31 on the package member 8. The identification mark 31 is configured to be placed in the reading area of the reflective sensor 32 (formed as shown in FIG. 8) only when the sheet package 9 is set in the printer 1 correctly avoiding the upside-down or back-to-front setting. If the sheet package 9 is loaded in the sheet storage unit 6 in a wrong direction, one of the aforementioned three error marks E necessarily comes to the position of the reflective sensor 32, by which the setting error of the sheet package 9 can be detected without fail.

Incidentally, there is a possibility that the user erroneously sets a closed sheet package 9 (with the flap part 8*a* closed) in the printer. This also causes the sheet feed error, and thus some countermeasure becomes necessary.

In this embodiment, the dimensions of the sheet storage unit 6 of the printer 1 and those of the sheet package 9 are determined so that the sheet package 9 can not be set in the printer 1 (the lid 10 of the printer 1 can not be closed) unless the sheet package 9 is opened and the flap part 8*a* is folded down to the base as shown in FIG. 1. Thus, the sensor 32 is not required to detect the unopened state of the sheet package 9.

It is also possible to let the sensor 32 detect the unopened state (with the flap part 8*a* closed). The detection becomes possible by the following configuration, for example. First, an error mark is also provided to the position of the identification mark 31 shown in FIG. 2, in place of the identification mark. Further, the size and the shape of the flap part 8*a* is set so as to hide the error mark when the flap part 8*a* is folded down to the base. Further, an identification mark is formed on the part of the flap part 8*a* facing the sensor 32 when the flap part 8*a* is folded down to the base (i.e. the part hiding the error mark).

By such a configuration, the error mark faces the sensor 32 when the sheet package 9 is unopened. When the sheet package 9 has been opened and the flap part 8*a* has been folded down to the base (when the flap part 8*a* has been opened), the error mark is hidden by the flap part 8*a* and the identification mark 31 on the flap part 8*a* faces the sensor 32.

In this case, the error mark is also provided to proper parts of the unopened sheet package 9 so that an error mark will face the sensor 32 when the unopened package is set in a wrong direction.

When a print instruction is supplied from an upper-level device (e.g., a personal computer) connected with the printer, the sensors 32*a*-32*d* of the reflective sensor 32 read the black/white pattern which is formed by the indicator bits 31*a*-31*d* of the identification mark 31. Since the pattern has been associated with a particular type of sheet as mentioned above, the printer can automatically judge the sheet type and thereby can control driving speeds of rollers and current supply to the thermal head automatically.

Since the identification mark 31 includes four indicator bits 31*a*-31*d*, the number of possible black/white combination patterns of the identification mark 31 (i.e. the number of sheet types that can be indicated by the mark) is $2^4=16$ theoretically.

However, among the 16 patterns, the all-white pattern (with all the four indicator bits being white) is not employed as the identification mark 31.

The all-white pattern is avoided for the discrimination of the identification mark 31 from the aforementioned error mark E. In this embodiment, a totally white part is regarded as the error mark E, and thus all the four sensors 32*a*-32*d* read "white" when the error mark E is in the reading area of the reflective sensor 32. The printer 1 of this embodiment judges that the direction of the sheet package is incorrect or the sheet package 9 is unopened when all the sensors 32*a*-32*d* detect "white". In this case, an unshown judgment unit judges the occurrence of the error and thereby a proper notification means informs the user of the error by alarm display (error indicator), alarm sound (buzzer), etc. to let the user cope with the situation.

In short, the all-white pattern (with four white bits) is not employed as the identification mark 31 so that such errors can securely be discriminated from the normal state in which the sheet package 9 is set correctly.

Further, an all-black pattern (with all the four indicator bits being black) is also not employed as the identification mark 31.

The all-black pattern is avoided for letting the printer 1 recognize an empty state with no sheet package 9 loaded in the sheet storage unit 6. With no sheet in the sheet storage unit 6, there is no object for reflecting the light emitted from the sensors 32*a*-32*d*, by which "black" is detected by all the sensors 32*a*-32*d*. Based on the fact, the printer 1 of this embodiment is configured to inform the user of the error when the sensors 32*a*-32*d* detect the all-black pattern, similarly to the above case of the error mark E.

In short, the all-black pattern (with four black bits) is not employed as the identification mark 31 so that such an error can securely be discriminated from the normal state in which the sheet package 9 is set correctly.

As described above, according to the embodiment of the present invention, when the sheet package 9 is loaded in the printer 1 in an incorrect direction, not the identification mark 31 but an error mark E is read by the reflective sensor 32 and thereby the user is informed of the error. Therefore, the user can reset the sheet package 9 in the correct direction avoiding the upside-down or back-to-front setting, by which failure and trouble in printing can be prevented.

The type of sheet can also be judged automatically by the detection of the information indicated by the identification mark, enabling automatic control of the printer depending on the sheet type.

Further, the simple indication of the information by several indicator bits allows simplification of the sensor for reading the information. The reflective sensor can be configured simply by arranging several sensors in a line corresponding to the indicator bits for example, by which the manufacturing cost can be reduced.

While the printer in the above embodiment only informs the user of an error when the error is detected by the reflective sensor 32, the printer may also be configured to automatically control its operation in this situation. In the case where the same value is read by all the sensors (all "white" or all "black")), the printer may also regulate its sheet feed operation along with informing the user of the error, by which the print failure/trouble can be prevented from occurring even if the user does not notice the error.

As set forth hereinabove, by the present invention, erroneous setting of the sheet package in the printer in an incorrect direction can be avoided and thereby the print failure/trouble can be prevented from occurring.

While the above embodiment has been presented as an illustration, various modifications can be made to the embodiment regarding the sizes, shapes, etc. of the flap part, the wrapping parts and the tongue part of the sheet package. The configuration of the identification mark and the sensor for reading the mark can also be modified in various ways, such as employing bar codes as the identification mark. Thus, the present invention is not to be restricted by the above particular illustrative embodiment but to be appreciated on the basis of the appended claims.

What is claimed is:

1. A system, comprising:

a sheet package including sheets as print mediums and a package member surrounding the sheets stacked up; and a printer using the sheet package, wherein:

the printer includes a sensor, the sheet package is configured so that the sheets can be set in the printer together with the package member exposing part of the sheets, the package member being provided with an identification mark so that the identification mark will be placed in a reading area of the sensor of the printer only when the sheet package is set in the printer in a correct direction, the printer operates depending on whether the identification mark can be read by the sensor or not;

the printer is configured to inform a user of an error when the identification mark can not be read by the sensor; and the printer is configured to regulate its sheet feed operation when the identification mark can not be read by the sensor, wherein the sheet package includes a plurality of error marks that each cause the sensor to detect an error, the error marks respectively formed at every part of the sheet package or the sheets that can be placed in the reading area of the sensor when the sheet package is set in the printer in an incorrect direction, the error mark being formed by a plurality of indicator bits indicating the same information, and wherein the printer is configured to inform the user of an error and regulate its sheet feed operation when all the sensors read the same value.

2. The system according to claim 1, wherein the identification mark indicates information on the sheets, and wherein the printer recognizes the type of the sheets by letting the sensor read the information on the sheets indicated by the identification mark.

3. The system according to claim 1, wherein the identification mark is formed by a plurality of indicator bits, and wherein the printer includes a plurality of sensors corresponding to the indicator bits forming the identification mark.

4. The system according to claim 1, wherein the sensor is implemented by a reflective sensor.

* * * * *